US007871363B1

(12) United States Patent
Branyon et al.

(10) Patent No.: US 7,871,363 B1
(45) Date of Patent: Jan. 18, 2011

(54) ARCED BUMPER PAD

(75) Inventors: Jacob Branyon, Springfield, TN (US); Kurt Welfel, Springfield, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 12/835,938

(22) Filed: Jul. 14, 2010

(51) Int. Cl.
*B31C 11/04* (2006.01)

(52) U.S. Cl. ..... 493/276; 493/287; 493/288; 493/293; 493/331

(58) Field of Classification Search ..... 493/276, 493/279, 280, 282, 283, 287, 288, 293, 331; 53/553, 563, 581
See application file for complete search history.

(56) References Cited

U.S. PATENT DOCUMENTS

| | | | | | |
|---|---|---|---|---|---|
| 2,208,951 | A | * | 7/1940 | Tamassy | 53/134.2 |
| 2,774,490 | A | * | 12/1956 | Strong | 206/598 |
| 2,930,481 | A | * | 3/1960 | Bebie | 206/597 |
| 3,112,715 | A | * | 12/1963 | Callahan et al. | 108/51.3 |
| 3,135,228 | A | * | 6/1964 | Fleming et al. | 108/57.34 |
| 3,244,347 | A | | 4/1966 | Jenk | |
| 3,315,867 | A | | 4/1967 | Seltman | |
| 3,344,916 | A | | 10/1967 | Brueckner | |
| 4,301,639 | A | * | 11/1981 | Hamilton | 53/456 |
| 4,864,802 | A | * | 9/1989 | D'Angelo | 53/450 |
| 4,865,201 | A | | 9/1989 | Liebel | |
| 5,244,087 | A | | 9/1993 | Hikake et al. | |
| 5,509,534 | A | * | 4/1996 | Taravella et al. | 206/587 |
| 5,746,871 | A | * | 5/1998 | Walsh | 156/268 |
| 6,286,683 | B1 | | 9/2001 | Hunt et al. | |

FOREIGN PATENT DOCUMENTS

EP 1547760 A1 6/2005

OTHER PUBLICATIONS

Sonoco FirmalLoad™ Bulk Bag Carrier Marketing Brochure (2010).

* cited by examiner

*Primary Examiner*—Thanh K Truong
(74) *Attorney, Agent, or Firm*—Miller, Matthias & Hull, LLP

(57) ABSTRACT

A bumper pad for use in cushioning and protecting packaged articles is provided. The bumper pad is made primarily from paper and comprises an arced top member glued or otherwise affixed to a flat base along longitudinal edges. The bumper pad can be placed around the packaged article between the article and the outer packaging, which can be a cardboard sleeve, stretch wrap film or other packaging material. The arced top member preferably is formed using a linear draw process.

1 Claim, 2 Drawing Sheets

ARCED BUMPER PAD

BACKGROUND OF THE INVENTION

1. Field of the Invention

This invention relates to a packaging component. More particularly, this invention relates to an arced bumper pad made of paper and intended for use as a spacer, blocking or bracing component for packaging products such as appliances, HVAC systems, furnaces, file cabinets and the like.

2. Description of the Related Art

Numerous references teach protective packaging components made of paper and used in the packaging of large articles. For example, the undated non-patent reference titled "FirmaLoad™ Bulk Bag Carriers", published by Sonoco Products Company, the exclusive licensee of the present invention, teaches a base for carrying bulk bags comprising a curved or arced member affixed to a flat base member. Like the present invention both the arced member and flat member are made from layers of paper laminated together. However, unlike the present invention, the arced members do not have flanges, are not made using a linear draw process, and are not glued to the base piece. Rather, the two arced members are formed by cutting a wound paper post lengthwise, and are affixed to the base with tape.

Jenk U.S. Pat. No. 3,244,347 is directed to a paperboard corner post having a curved outer portion and a pair of integral convex cushioning portions. In making the post, a spiral wound tube is cut to the desired length, scored along diametrically opposite parallel lines and then slit the full length between the score lines to form a pair of quarter-cylindrical sections joined at the score lines to a semi-cylindrical section. The quarter-cylindrical sections are then folded inwardly until they engage the inner concave surface of the semi-cylindrical section. Jenk does not teach a two piece cushioning post comprising an arced top member adhered to a flat base member like the present invention.

Seltman U.S. Pat. No. 3,315,867 is directed to a corner post comprising two curved portions connected together along a common edge. Seltman does not teach a two piece cushioning post comprising an arced top member adhered to a flat base member like the present invention.

Brueckner U.S. Pat. No. 3,344,916 is directed to a one piece tubular cushioning member that fits over the edge of a fragile article such as a mirror. The cushioning member is formed from a hollow paper tube. Referring to FIG. 2, two parallel transverse slits are cut into the tube so that the material between the slits can be bent downwardly to form a flat tongue 15 which abuts an edge of the minor. Although the Brueckner device has an arced portion (the tube wall) and a flat portion (the tongue 15), Brueckner does not disclose a two piece support post comprising an arced top member adhered to a flat base member like the present invention.

Liebel U.S. Pat. No. 4,865,201 is directed to a corner post comprising a corrugated core sandwiched between flat inner and outer members. Like the present invention, the Liebel corner post has an arced member adhered to a flat member. Unlike the present invention, Liebel does not disclose an arced member made using a linear draw process, an arced member having flat flanges for adhering to a separate flat member, or an arced member made from multiple plies.

Hikake et al. U.S. Pat. No. 5,244,087 is directed to a container for an ink jet cartridge. Like the present invention, the container comprises a curved protective member (32) adhered to a flat base member (31). Unlike the present invention, the Hiakake container is not made from paper, much less paper that has been shaped in an arced top member using a linear draw process. Also, Hikake does not disclose an elongated arced top member having a semicircular cross section.

Hunt et al. U.S. Pat. No. 6,286,683 (co-owned by Sonoco) is directed to a two piece corner post comprising a substantially L-shaped outer member (away from the packaged product) and an inner (product facing) member adhered to the outer member. The outer member is made from layers of paper laminated together and can be shaped into any desirable shape, including one having arced or curved portions. Unlike the present invention, Hunt does not teach that the outer member can comprise an arced portion having a semicircular cross section with a curvature equal to or less than 180 degrees and two opposing planar flanges extending outward from the longitudinal edges of the arced portion. Further, Hunt does not disclose a post formed using a linear draw process.

Qiu et al. European Patent No. EP 1,547,760 (owned by Sonoco) is directed to a multiple grade paper support post made using a linear draw process. However, the Qiu patent does not teach a two piece cushioning post comprising an arced top member adhered to a flat base member like the present invention.

While these packaging components may be suitable for their intended purpose none is a two piece, all paper packaging component comprising an arced member having flanges adhered to a flat base member. Furthermore, none of the references teach a two piece packaging component having an arced member made via linear draw.

Thus it is an object of the present invention to provide a two piece, all paper packaging component comprising an arced member having flanges adhered to a flat base member.

Another object of the present invention is to provide a two piece packaging component having an arced member made via linear draw.

Further and additional objects will appear from the description, accompanying drawings, and appended claims.

BRIEF SUMMARY OF THE INVENTION

The present invention is an arced bumper pad for use in cushioning and protecting packaged articles is provided. The bumper pad is made primarily from paper and comprises an arced top member glued or otherwise affixed to a flat base. The bumper pad can be placed around the packaged article between the article and the outer packaging, which can be a cardboard sleeve, stretch wrap film or other packaging material. The arced top member preferably is made using a linear draw process.

DETAILED DESCRIPTION OF THE INVENTION

Figure 1:
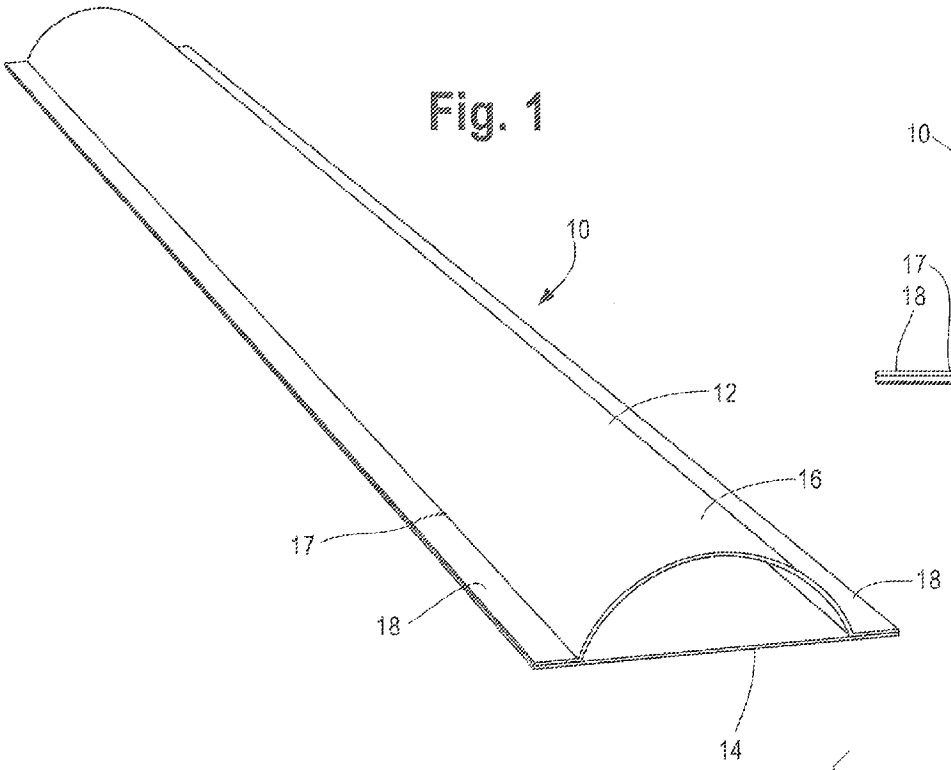
FIG. 1 is a perspective view of an arced bumper pad according to the present invention.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

The Arced Bumper Pad

The invention is a packaging component (aka "arced bumper pad" or just "bumper pad") intended for use as a spacer, blocking or bracing component for packaging products such as appliances, HVAC systems, furnaces, file cabinets and the like. The arced bumper pad is made from paper and can be easily recycled after use.

Figure 2:
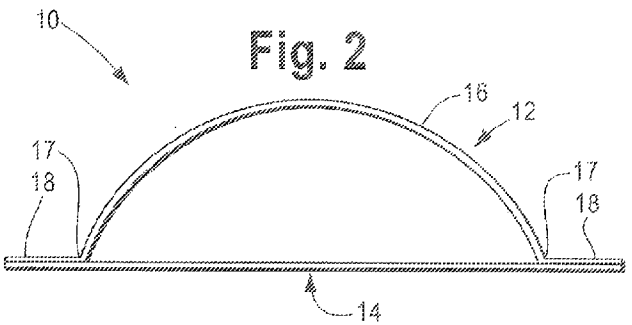
FIG. 2 is an end elevational view of the arced bumper pad of FIG. 1, the opposite end view being substantially the same.
Figure 3:
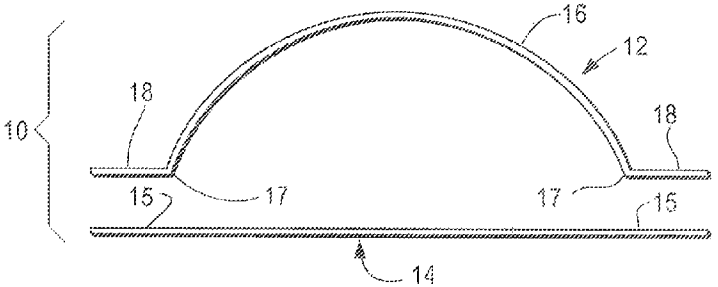
FIG. 3 is an exploded end view of the arced bumper pad of FIG. 1.

Turning to the drawings, there is shown in FIGS. 1-3 one embodiment of a bumper pad according to the present invention. The bumper pad 10 comprises an elongated resilient arced top member 12 adhered to an elongated flat base member 14. The bumper pad 10 is intended to replace honeycomb or other similar protective packaging materials.

The top member 12 comprises an arced portion 16 and two integrally formed, parallel longitudinal flat co-planar flanges 18. The arced portion 16 preferably has a semicircular cross section with a curvature equal to or less than 180 degrees that terminates in two parallel longitudinal creases 17. The arced portion 16 can vary in width and height, but the operable ratio of width to height is between about 6:1 and 2:1. It has been found that in some applications the strongest bumper pad arced portion is one having a width to height ratio of about 2:1. The flanges 18 are affixed to the arced portion 16 along the opposing longitudinal creases 17 and extend outwardly from the creases 17 in opposite directions. The top member 12 can be made from a single ply or multiple plies of paper to create a rigid or semi-rigid structure.

The base member 14 is substantially flat and rectangular and has two longitudinal edges 15 running its entire length. The width and length of the base member 14 should be substantially the same as that of the top member 12.

The top member 12 and the base member 14 may be made from one ply of paper based material or multiple plies of paper based material laminated together.

The Method of Forming the Arced Bumper Pad

Figure 4:
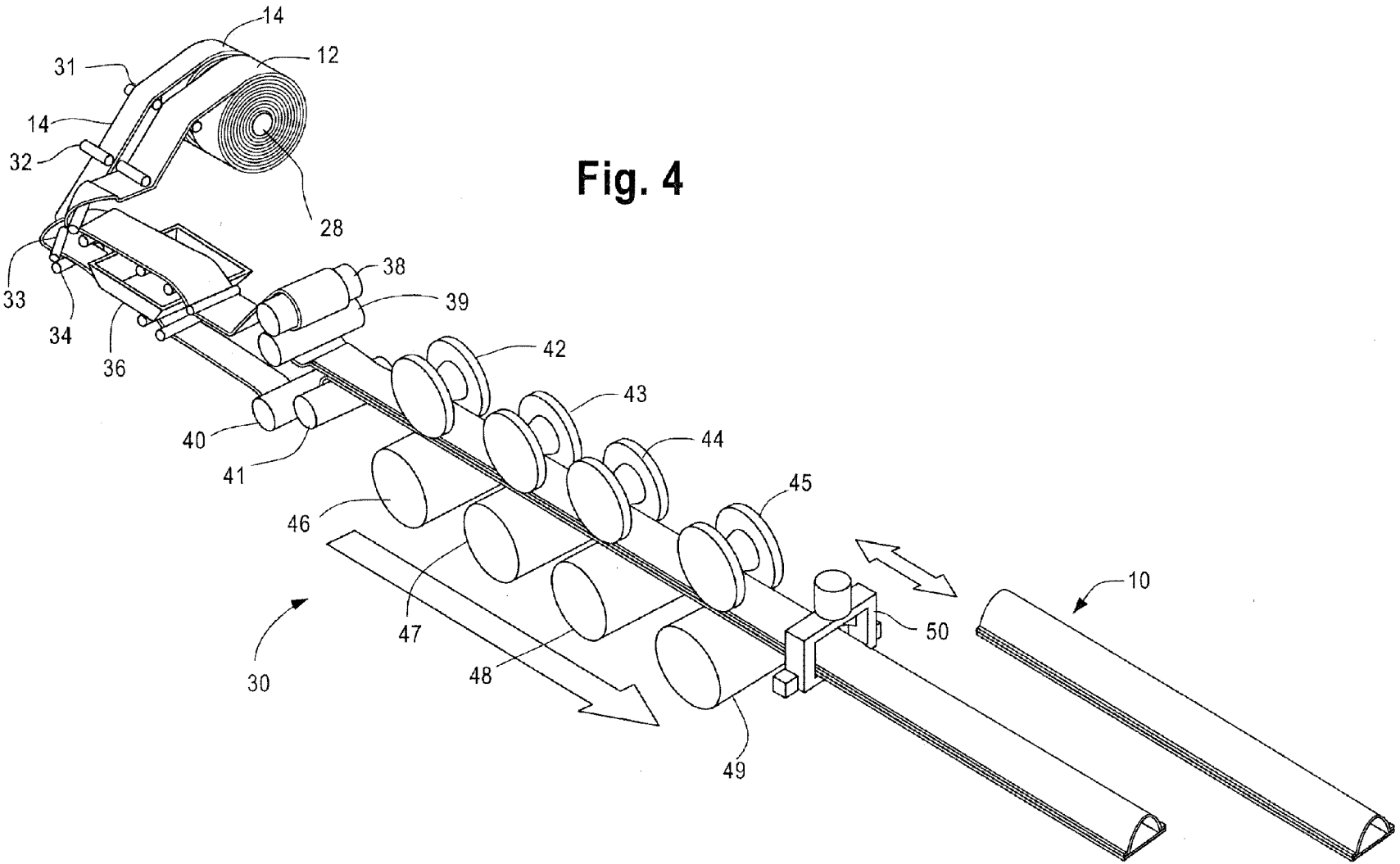
FIG. 4 is a perspective view of an apparatus used to make the arced bumper pad of FIG. 1.

The arced bumper pad 10 may be made using a linear draw process, wherein a web of material is drawn by rollers along a linear path in-line with the axis of a mandrel. FIG. 4 is a perspective view of a linear draw apparatus 30 used to make the arced bumper pad of FIG. 1. The apparatus 30 includes a first (top ply) reel 28 which carries a top ply 12 used to make the arced top member 12 and a second (bottom ply) reel which carries a bottom ply 14 used to make the flat bottom member 14, both mounted at one end of the apparatus 30.

Although referred to herein as "the top and bottom plies 12, 14", the plies 12, 14 may be made from a single ply of paper or multiple plies of paper laminated together. Prior to forming, the top ply 12 should have a width greater than that of the bottom ply 14 so that, after the top ply is formed into the arced top member 12, its width is substantially the same as that of the flat bottom member 14. Both the top ply 12 and the bottom ply 14 have a central region interposed between two longitudinal edges.

As the top ply 12 and the bottom ply 14 are drawn from the reels they are guided by a first series of rollers 31, 32, 33, 34 so that one or both passes through a gluing station 36 which coats the edges of the top and/or bottom plies 12, 14 so they can be bonded together.

Next, the top ply 12 passes over a series of upper guide rollers 38 and 39 while the bottom ply 14 passes over a series of lower guide rollers 40 and 41 until the top and bottom plies 12, 14 are in close parallel alignment.

The central portion of the top ply 12 is then drawn up around a floating mandrel (not shown) which is suspended between the top and bottom plies 12, 14. That part of the top ply 12 drawn up around the mandrel is shaped to become the arced portion 16 of the top member 12, while the remaining longitudinal edges of the top ply 12 that are not drawn around the floating mandrel become the two opposing coplanar flanges 18 that extend outwardly from the arced portion 16. At the same time that the top ply 12 is being partially drawn around the floating mandrel the bottom ply 14 is being drawn along the underside of the floating mandrel and remains flat.

The shaped top and bottom plies 12, 14 are drawn along the floating mandrel by a series of forming rollers 42, 43, 44 and 45 and opposing suspension rollers 46, 47, 48 and 49. The forming rollers 42, 43, 44 and 45 and suspension rollers 46, 47, 48 and 49 perform the additional function of maintaining the floating mandrel in a constant horizontal position by maintaining contact with the floating mandrel through the top and bottom plies 12, 14. The forming rollers 42, 43, 44 and 45 and suspension rollers 46, 47, 48 and 49 also help bond the top and bottom plies 12, 14 together by compressing the edges of the top and bottom plies 12, 14 between the sets of rollers, thereby sealing the edges together to form a closed tubular structure having a flat bottom surface and an arced top surface.

The floating mandrel should be shaped in accordance with the desired shape of the bumper pad 10. The floating mandrel can be replaced with a floating mandrel having a different desired shape.

Located downstream of the forming and suspension rollers is a cutting device 50 for cutting the formed and bonded top and bottom plies 12, 14 into a desired length. The finished bumper pad 10 is then ready for use. An additional (optional) sheet of paper can be placed over and adhered to the top member 12 and at least part of the base member 14 to add more strength to the finished bumper pad 10.

Uses

The bumper pad 10 is intended to replace honeycomb, foam and other packaging materials used to protect packaged articles. The bumper pad 10 typically is placed between the packaged item and the outer packaging, which can be a cardboard sleeve, stretch wrap film or other packaging material. For example, in one anticipated application, the bumper pad 10 is used to replace a 4×78 inch piece of honeycomb running vertically along the side of a packaged furnace.

This there is provided a bumper pad for use in cushioning and protecting packaged articles such as large household appliances, HVAC systems, furnaces, file cabinets and the like. The bumper pad is made primarily from paper and comprises an arced top member glued or otherwise affixed to a flat base. The bumper pad can be placed around the packaged article between the article and the outer packaging, which can be a cardboard sleeve, stretch wrap film or other packaging material.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

We claim as our invention:

1. A method of making an arced bumper pad comprising the steps of:

providing a top ply of paper having a central portion interposed between two longitudinal flanges and a bottom ply of paper having two longitudinal edges;

drawing the top ply and/or the bottom ply so that one or both passes through a gluing station which coats the longitudinal flanges of the top ply and/or the longitudinal edges of the bottom ply;

drawing the top and bottom plies around a series of rollers until the plies are in close parallel alignment;

providing a floating mandrel suspended between the top and bottom plies, the floating mandrel having an arced topside and flat underside;

drawing the central portion of the top ply around the topside of the floating mandrel so that the central portion assumes an arc shape while the longitudinal flanges of the top ply remain flat and extend outwardly from the central portion;

drawing the bottom ply along the underside of the floating mandrel;

compressing the longitudinal flanges of the top ply and the longitudinal edges of the bottom ply together between a series of forming rollers and opposing suspension rollers to bond the longitudinal flanges and longitudinal edges together to provide a shaped and bonded part; and cutting the shaped and bonded part to a desired length to provide the arced bumper pad.

* * * * *